US008543038B2

(12) United States Patent
Ito

(10) Patent No.: US 8,543,038 B2
(45) Date of Patent: Sep. 24, 2013

(54) IMAGE FORMING APPARATUS

(75) Inventor: Yukifumi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 491 days.

(21) Appl. No.: 12/778,414

(22) Filed: May 12, 2010

(65) Prior Publication Data

US 2010/0290810 A1 Nov. 18, 2010

(30) Foreign Application Priority Data

May 15, 2009 (JP) ..... 2009-118226

(51) Int. Cl.
*G03G 15/00* (2006.01)

(52) U.S. Cl.
USPC ..... 399/167; 399/111

(58) Field of Classification Search
USPC ..... 399/111, 116, 117, 159, 167; 74/412 R
See application file for complete search history.

(56) References Cited

U.S. PATENT DOCUMENTS

2007/0031166 A1* 2/2007 Zensai ..... 399/167

FOREIGN PATENT DOCUMENTS

| | | | |
|---|---|---|---|
| JP | 2001-134041 | | 5/2000 |
| JP | 2007-78720 | A | 3/2007 |
| JP | 2007-120609 | A | 5/2007 |
| JP | 2007120609 | A * | 5/2007 |

* cited by examiner

*Primary Examiner* — Walter L Lindsay, Jr.
*Assistant Examiner* — Jessica L Eley
(74) *Attorney, Agent, or Firm* — Kubotera & Associates, LLC

(57) ABSTRACT

An image forming apparatus includes a first image supporting member for forming a first image; a second image supporting member arranged adjacent to the first image supporting member for forming a second image; a first drive unit for driving the first image supporting member through a first driving force having a first phase; a second drive unit for driving the second image supporting member through a second driving force having a second phase shifted from the first phase; and a transfer unit for transferring the first image and the second image to a printing medium.

13 Claims, 12 Drawing Sheets

IMAGE FORMING APPARATUS

BACKGROUND OF THE INVENTION AND RELATED ART STATEMENT

The present invention relates to an image forming apparatus. More specifically, the present invention relates to an image forming apparatus for transferring toner images formed on a plurality of image supporting members to a transfer member to form a color image.

In a conventional image forming apparatus of an electrophotography type such as a printer, a facsimile, a copier, a multi function product (MFP), and the likes, there is provided a printing mechanism. In the printing mechanism, after a charging roller charges an image supporting member (a photosensitive drum), an exposure unit exposes the photosensitive drum to form a static latent image thereon. After the static latent image is formed on the photosensitive drum, a developing roller attaches toner or developer to the static latent image with an electrostatic force to form or develop a toner image. Afterward, a transfer roller transfers or prints the toner image to a printing medium.

In the conventional image forming apparatus, a plurality of the printing mechanisms is provided for forming toner images in colors. A transportation belt or a transfer belt is provided for transporting the printing medium, and the toner images in colors formed with the printing mechanisms are transferred and overlapped on the printing medium, thereby forming a color image.

In the conventional image forming apparatus described above, when a color shift (i.e., a shift in printing positions of the toner images in colors) occurs, printing quality is deteriorated. In order to prevent the color shift, in the conventional image forming apparatus, when the toner images in each color are transferred and overlapped on the transportation belt, it is configured to detect an amount of the shift in the printing positions of the toner images in each color on the transportation belt. Accordingly, an operation of the printing mechanisms is controlled according to the amount of the shift in the printing positions thus detected (refer to Patent Reference). Patent Reference: Japanese Patent Publication No. 2001-134041

In the conventional image forming apparatus described above, a gear is generally provided for engaging with another gear provided on the photosensitive drum to drive the photosensitive drum as the image supporting member. The gear is normally formed of a multiple stage (for example, a two-stage gear) for decelerating and transmitting rotational drive from a drive source to the photosensitive drum. The gear for driving the photosensitive drum tends to exhibit a specific characteristic such as a deviation due to a dimensional accuracy of the gears engaging with other or a waggle tolerance of the gear from an axial center thereof.

When the gear for driving the photosensitive drum has the specific characteristic or a gear specific characteristic, the gear specific characteristic tends to influence on a rotation of the photosensitive drum, thereby causing a variation in the rotation of the photosensitive drum. The variation in the rotation of the photosensitive drum may be transmitted to the transportation belt. When the variation is transmitted to the transportation belt, a moving speed of the transportation belt may be fluctuated, thereby causing the color shift (i.e., the shift in the printing positions of the toner images in each color). Accordingly, the conventional image forming apparatus has the configuration in which the color shift tends to easily occur due to the influence of the gear specific characteristic.

In the conventional image forming apparatus described above, when a pitch distance is set at an optimal level, it is possible to prevent the color shift through a simple control of the printing mechanisms. More specifically, when the pitch distance is set at the optimal level, a transportation distance of the printing medium relative to a cycle of a speed fluctuation of the photosensitive drum becomes a fraction of an integer of the pitch distance.

In the conventional image forming apparatus described above, however, it is difficult to set the pitch distance at the optimal level due to a restriction of an apparatus size and a cost. In this case, since the pitch distance is not set at the optimal level, it is difficult to prevent the color shift through a simple control of the printing mechanisms. In other words, in the conventional image forming apparatus described above, when it is difficult to set the pitch distance at the optimal level, it is difficult to prevent the color shift through a simple control of the printing mechanisms.

In view of the problems described above, an object of the present invention is to provide an image forming apparatus capable of solving the problems of the conventional image forming apparatus and preventing the color shift through a simple control of printing mechanisms even when it is difficult to set a pitch distance at an optimal level.

Further objects and advantages of the invention will be apparent from the following description of the invention.

SUMMARY OF THE INVENTION

In order to attain the objects described above, according to a first aspect of the present invention, an image forming apparatus includes a first image supporting member for forming a first image; a second image supporting member arranged adjacent to the first image supporting member for forming a second image; a first drive unit for driving the first image supporting member through a first driving force having a first phase; a second drive unit for driving the second image supporting member through a second driving force having a second phase shifted from the first phase; and a transfer unit for transferring the first image and the second image to a printing medium.

According to a second aspect of the present invention, an image forming apparatus includes a first image supporting member for forming a first image; a second image supporting member arranged adjacent to the first image supporting member for forming a second image; a first drive unit including a first gear for driving the first image supporting member, said first gear having a first rotational phase; a second drive unit including a second gear for driving the second image supporting member, said second gear having a second rotational phase shifted from the first rotational phase by an angle of about 180 degrees; and a transfer unit including a transportation belt for transferring the first image and the second image to a printing medium.

DETAILED DESCRIPTION OF PREFERRED EMBODIMENTS

Figure 1:
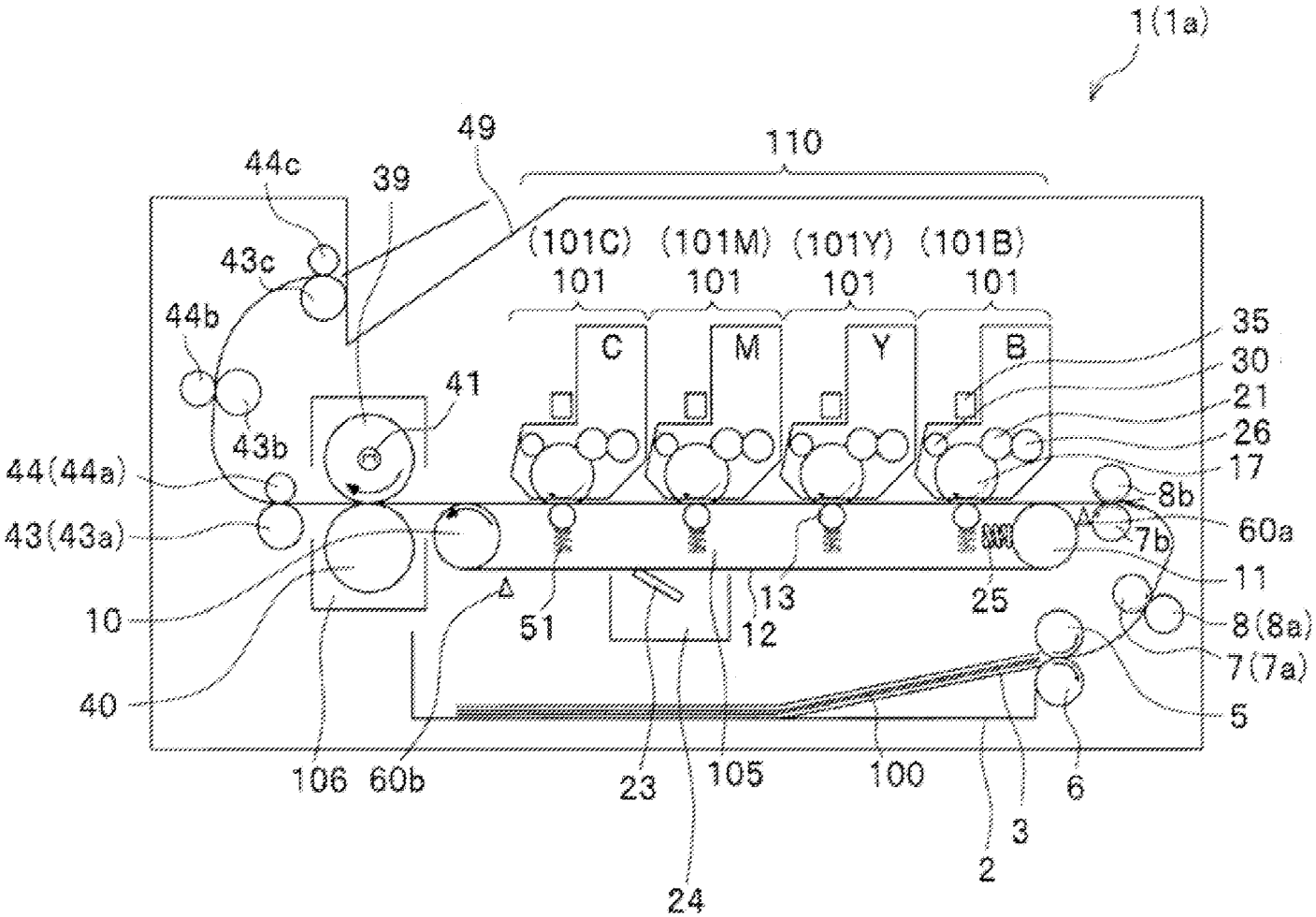
FIG. 1 is a schematic sectional view showing an image forming apparatus according to a first embodiment of the present invention.

Hereunder, embodiments of the present invention will be explained with reference to the accompanying drawings. In the following description, the accompanying drawings merely show embodiments of the present invention for describing the present invention. Accordingly, the present invention is not limited to the embodiments shown in the accompanying drawings. Similar components and similar elements are designated with the same reference numerals (or the same reference numerals with an alphabet at an end thereof), and explanations thereof are omitted.

First Embodiment

A first embodiment of the present invention will be explained with reference of FIGS. 1 to 5. In the following description, it is supposed that an image forming apparatus 1 is a printer of a tandem type using a color electro-photography recording process.

First, a configuration of the image forming apparatus 1 according to the first embodiment of the present invention will be explained. FIG. 1 is a schematic sectional view showing an entire configuration of the image forming apparatus 1 according to the first embodiment of the present invention.

As shown in FIG. 1, the image forming apparatus 1 includes a sheet supply cassette 2, so that a printing medium 100 is retained in the sheet supply cassette 2. A sheet receiver 3 is disposed inside the sheet supply cassette 2 for supporting the printing medium 100. When a pushup spring (not shown) pushes up the sheet receiver 3, the printing medium 100 contacts with a sheet supply roller 5 and a pressure roller 6.

In the embodiment, the sheet supply roller 5 is provided for picking up the printing medium 100 from the sheet supply cassette 2. The pressure roller 6 is disposed at a position facing the sheet supply roller 5, and rotates following rotations of the sheet supply roller 5. The sheet supply roller 5 and the pressure roller 6 guide the printing medium 100, so that the printing medium 100 is transported from the sheet supply cassette 2 toward a transportation path.

In the embodiment, after the printing medium 100 is picked up, a register roller 7 and a pressure roller 8 guide the printing medium 100, so that the printing medium 100 is further transported along the transportation path. The register roller 7 is provided for transporting the printing medium 100. The pressure roller 8 is disposed at a position facing the register roller 7, and rotates following rotations of the register roller 7. As shown in FIG. 1, a register roller 7*a* and a pressure roller 8*a* are disposed on an upstream side of the transportation path, and a register roller 7*b* and a pressure roller 8*b* are disposed on a downstream side of the transportation path.

In the embodiment, the register roller 7 transports the printing medium 100 through a sheet sensor 60*a* to a transfer belt unit 105. The sheet sensor 60*a* is provided for detecting a leading edge and a trailing edge of the printing medium 100. The sheet sensor 60*a* also functions as a writing sensor for defining a writing position of the printing medium 100 (a transfer position of a toner image).

In the embodiment, the transfer belt unit 105 functions as a mechanism for moving a transportation belt 12 as a transfer belt. The transfer belt unit 105 includes a belt drive roller 10; a belt idle roller 11; the transfer belt 12; transfer rollers 13; a spring 25; a cleaning blade 23; a collected toner box 24; springs 51; a belt drive motor 201 (refer to FIG. 2); and the like.

In the embodiment, the transportation belt 12 functions as a belt for transporting the printing medium 100, and also functions as the transfer belt where the toner image is transferred. The transportation belt 12 is formed of a film member without an end portion. Components such as the belt drive roller 10, the belt idle roller 11, and the transfer rollers 13 extend the transportation belt 12 between the belt drive roller 10 and the belt idle roller 11. When the belt drive motor 201 drives and rotates the belt drive roller 10, the transportation belt 12 moves through a frictional force with the belt drive roller 10.

In the embodiment, the transfer rollers 13 are provided for applying a transfer voltage to a transfer medium (the printing medium 100 and the transportation belt 12), so that a developer image (the toner image) is transferred. The transfer rollers 13 are disposed inside the transportation belt 12 without the end portion. The transfer rollers 13 are arranged at a plurality of locations (four locations in the embodiment) corresponding to photosensitive drums 17 in each color.

In the embodiment, the spring 25 functions as an urging member for urging the belt idle roller 11. More specifically, the spring 25 urges the belt idle roller 11 in a direction away from the belt drive roller 10, so that the transportation belt 12 is extended without being loosen. Accordingly, the spring 25 applies tension to the transportation belt 12.

In the embodiment, the cleaning blade 23 is provided for scraping off developer (toner) transferred to a surface of the transportation belt 12. The collected toner box 24 is provided for collecting toner scraped off with the cleaning blade 23.

In the embodiment, the springs 51 function as an urging member for urging the transfer rollers 13. More specifically, the springs 51 urge the transfer rollers 13 toward the photosensitive drums 17 (described later). The belt drive motor 201 (refer to FIG. 2) functions as a drive unit for driving the belt drive roller 10 to rotate, so that the transportation belt 12 moves.

In the embodiment, an exposure unit 35 and an image drum unit 101 (referred to as an ID unit 101) are arranged above each of the transfer rollers 13. The exposure unit 35 is provided for exposing the photosensitive drum 17 of the ID unit 101, so that a static latent image is formed on the photosensitive drum 17. The ID unit 101 is provided for forming an image on the photosensitive drum 17.

In the embodiment, the ID unit 101 includes the photosensitive drum 17, a charging roller 30, a supply roller 26, a developing roller 21, and the like. The photosensitive drum 17 functions as the image supporting member on which the static latent image is formed. The charging roller 30 is provided for supplying a specific charge to the photosensitive drum 17, so that the photosensitive drum 17 is charged. The supply roller 26 is provided for supplying a sufficient amount of toner to the photosensitive drum 17. The developing roller 21 is provided for charging toner, so that toner is attached to the static latent image formed on the photosensitive drum 17 to form the toner image with a specific layer thickness.

In the embodiment, the photosensitive drum 17 is disposed above the transportation belt 12, so that the photosensitive drum 17 faces the transfer roller 13 with the transportation belt 12 in between. The charging roller 30, the supply roller 26, and the developing roller 21 are disposed around the photosensitive drum 17, so that the charging roller 30, the supply roller 26, and the developing roller 21 are pressed against the photosensitive drum 17.

In the embodiment, the image forming apparatus 1 includes four ID units 101 corresponding to colors of black (B), yellow (Y), magenta (M), and cyan (C). Accordingly, the ID units 101 constitute an image forming portion 110 for forming a color image. The ID units 101 have an identical configuration except retaining toner in a different color.

In the following description, it is supposed that the ID units 101 are produced using identical components through a same manufacturing process, so that the ID units 101 have an identical operational characteristic. When it is necessary to differentiate a component corresponding to each color, the component is designated with a reference numeral attached with an alphabetical letter B, Y, M, or C such as the ID unit 101B, 101Y, 101M, or 101C.

In the image forming apparatus 1, when the printing medium 100 is transported to the transfer belt unit 105, the belt drive motor 201 (refer to FIG. 2) is driven to move the transportation belt 12. Accordingly, the printing medium 100 passes through under the ID units 101B, 101Y, 101M, and 101C. At this moment, in the image forming apparatus 1, after the charging rollers 30 charge the photosensitive drums 17 as the image supporting members, the exposure units 35 expose the photosensitive drums 17 to form the static latent images thereon. Then, the developing rollers 21 attach toner to the static latent images through an electro-static force to form the toner images, so that the transfer rollers 13 transfer (print) the toner images to the printing medium 100. Through the process described above, the color image is formed on the printing medium 100.

After the color image is formed on the printing medium 100, the transfer belt unit 105 transports the printing medium 100 to a fixing unit 106. The fixing unit 106 includes a fixing roller 39, a pressing roller 40, a halogen lamp 41, a fixing unit drive motor 204 (refer to FIG. 2), and the like. The fixing roller 39 is provided for fixing the toner images to the printing medium 100. The pressing roller 40 is arranged to face the fixing roller 39, and rotates following a rotation of the fixing roller 39. The halogen lamp 41 is disposed inside the fixing roller 39 as a heating source for heating the printing medium 100. The fixing unit drive motor 204 is a drive unit for driving the fixing roller 39 to rotate.

In the image forming apparatus 1, the halogen lamp 41 heats the printing medium 100, and the fixing roller 39 and the pressing roller 40 press and transport the printing medium 100, so that the toner images transferred to the printing medium 100 are melted and fixed to the printing medium 100.

After the toner images are fixed to the printing medium 100, the fixing unit 106 transports the printing medium 100 to a discharge roller 43 and a discharge roller 44. The discharge roller 43 transports and discharges the printing medium 100 to a facedown stacker 49. The discharge roller 44 is arranged to face the discharge roller 43, and rotates following a rotation of the discharge roller 43. More specifically, a discharge roller 43*a* and a discharge roller 44*a* are disposed on an upstream side of the transportation path, and a discharge roller 43*b* and a discharge roller 44*b* are disposed on a downstream side of the transportation path. Accordingly, the discharge roller 43 transports and discharges the printing medium 100 to the facedown stacker 49.

Figure 2:
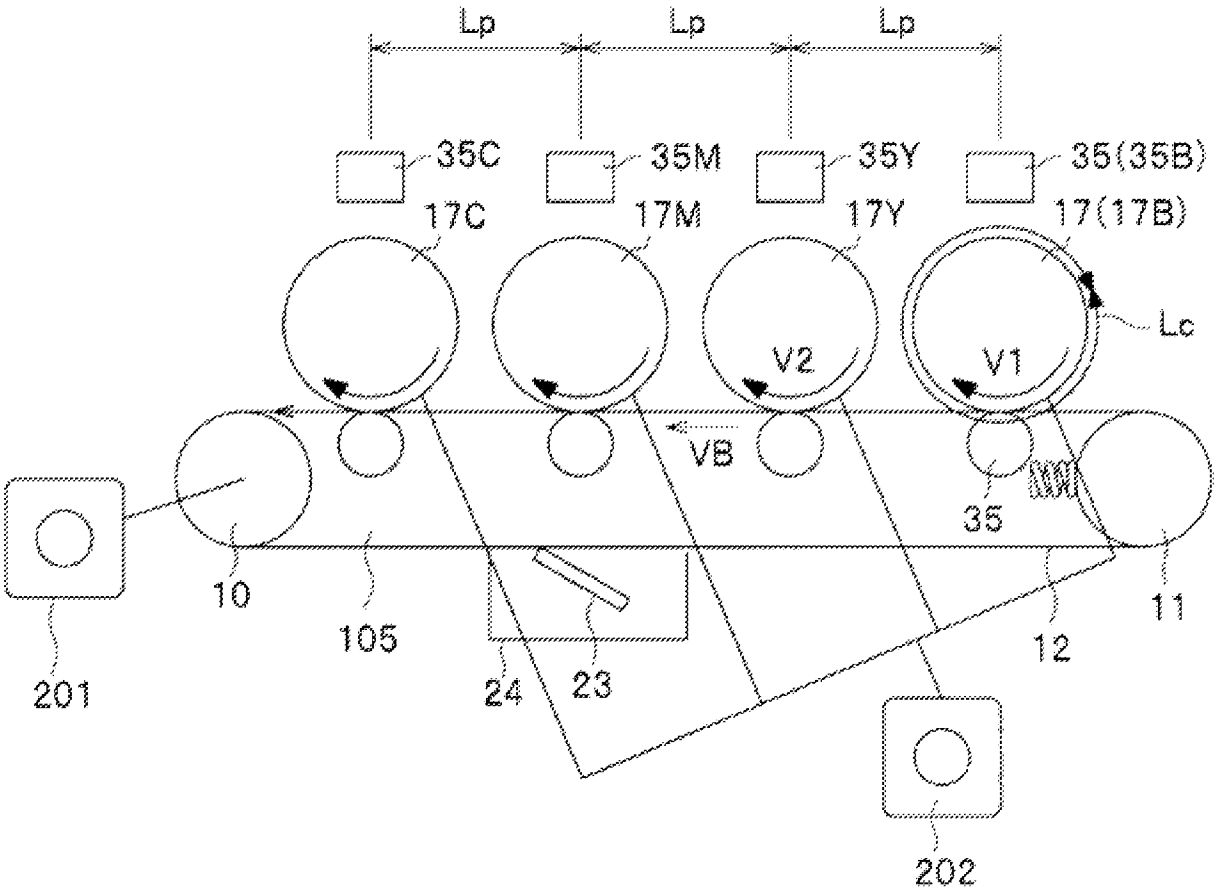
FIG. 2 is a schematic view showing a configuration around a transportation belt of the image forming apparatus according to the first embodiment of the present invention.

A configuration around the transportation belt 12 of the image forming apparatus 1 will be explained next with reference to FIG. 2. FIG. 2 is a schematic view showing the configuration around the transportation belt 12 of the image forming apparatus 1 according to the first embodiment of the present invention.

As shown in FIG. 2, in the image forming apparatus 1, the transportation belt 12 is extended between the belt drive roller 10 and the belt idle roller 11. A drive of the belt drive motor 201 is transmitted to the belt drive roller 10 through a drive transmission mechanism (not shown). Accordingly, the belt drive roller 10 rotates, so that the transportation belt 12 moves through friction between the transportation belt 12 and the belt drive roller 10.

As described above, in the image forming apparatus 1, the transfer rollers 13 corresponding to colors of black (B), yellow (Y), magenta (M), and cyan (C) are disposed inside the loop of the transportation belt 12 without the end portion. Further, the photosensitive drums 17B, 17Y, 17M, and 17C of the ID units 101 (refer to FIG. 1) are disposed at an upper portion of the image forming apparatus 1 to face the transfer rollers 13, respectively.

In the embodiment, the photosensitive drums 17B, 17Y, 17M, and 17C of the ID units 101 have an outer circumferential length Lc. Further, the ID units 101 are arranged with a pitch distance Lp (an distance between axes of the photosensitive drums 17B, 17Y, 17M, and 17C). A drive of an ID unit drive motor 202 is transmitted to the photosensitive drums 17B, 17Y, 17M, and 17C through a drive transmission mechanism (not shown).

In the embodiment, the ID units 101 are positioned at a specific location in a lateral direction with a side plate (not shown). The exposure unit 35 is situated above each of the ID units 101. The exposure units 35 are positioned at specific locations in a lateral direction with the side plate (not shown) of the ID units 101.

A configuration of gears for driving the image supporting members (the photosensitive drums 17) of the image forming apparatus 1 will be explained next with reference to FIGS. 3 and 4.

Figure 3:
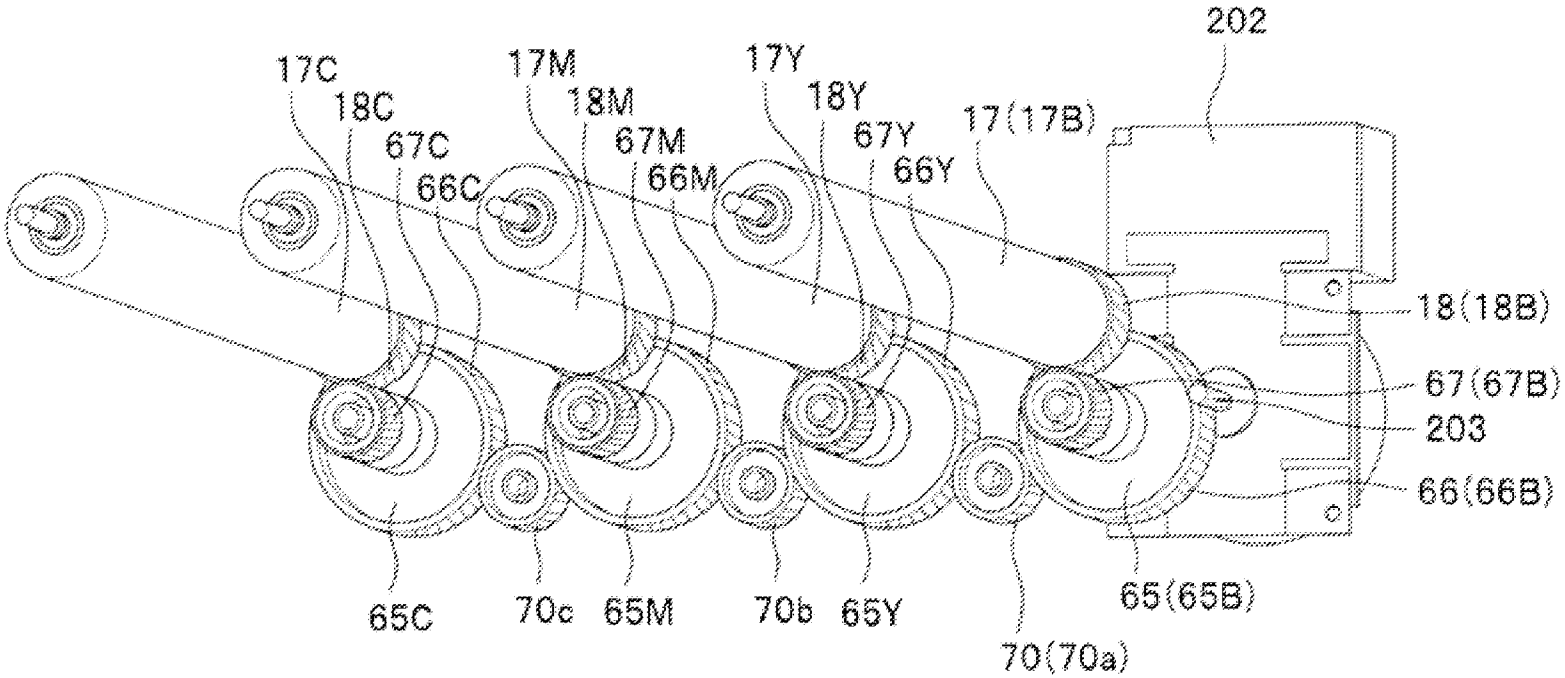
FIG. 3 is a schematic view showing a configuration of gears for driving an image supporting member of the image forming apparatus according to the first embodiment of the present invention.

FIG. 3 is a schematic view showing the configuration of the gears for driving the image supporting members 17 of the image forming apparatus 1 according to the first embodiment of the present invention. More specifically, FIG. 3 is a schematic perspective view showing an example of a drive unit for driving the photosensitive drums 17.

Figure 4:
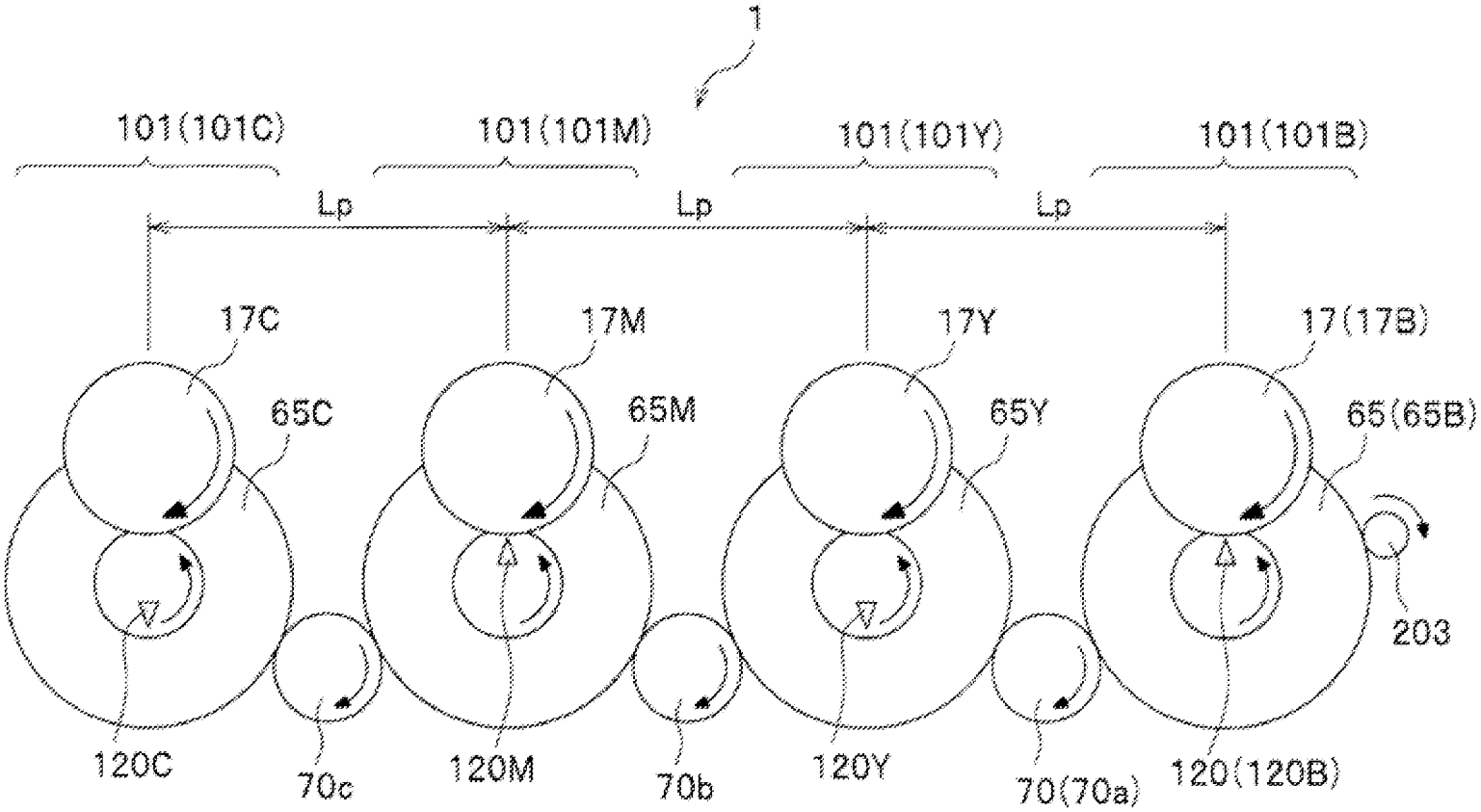
FIG. 4 is a schematic view showing a rotational phase of the gears of the image forming apparatus according to the first embodiment of the present invention.

FIG. 4 is a schematic view showing a rotational phase of the gears of the image forming apparatus 1 according to the first embodiment of the present invention. More specifically, FIG. 4 is a schematic view showing rotational phases of two gears for driving the photosensitive drums 17.

As shown in FIG. 3, the image forming apparatus 1 includes the ID unit drive motor 202 and four deceleration idle gears 65 (or deceleration gears 65) corresponding to the photosensitive drums 17 in each color. Each of the deceleration idle gears 65 functions as a transmission member for decelerating and transmitting the drive of the ID unit drive motor 202 to the photosensitive drum 17. Each of the deceleration idle gears 65 includes a large gear 66 and a small gear 67.

In the embodiment, the large gear 66 engages a motor gear 203 for transmitting the drive of the ID unit drive motor 202 and an idle gear 70 or a connecting gear 70 for connecting the deceleration idle gears 65. The connecting gears 70 are disposed at three locations along the transportation direction of the printing medium 100. The connecting gear 70 disposed at a first row of the three locations connects the photosensitive drum 17B at a first row and the photosensitive drum 17Y at a second row. The connecting gear 70 disposed at a second row of the three locations connects the photosensitive drum 17Y at the second row and the photosensitive drum 17M at a third row. The connecting gear 70 disposed at a third row of the three locations connects the photosensitive drum 17M at the third row and the photosensitive drum 17C at a fourth row.

In the following description, the connecting gears 70 are designated as the connecting gears 70*a*, 70*b*, and 70*c* when it is necessary to be differentiated for each color. The connecting gears 70*a*, 70*b*, and 70*c* have an identical diameter.

In the embodiment, the small gear 67 engages a gear 18 or a photosensitive drum gear 18 disposed along an outer circumference of the photosensitive drums 17 at an end portion thereof. The photosensitive drum gears 18 of the photosensitive drums 17 have an identical diameter.

In the embodiment, the image forming apparatus 1 includes four drive units. The first drive unit is formed of a photosensitive drum gear 18B for driving the photosensitive drum 17B, a deceleration gear 65B as a first gear, and the motor gear 202. The second drive unit is formed of a photosensitive drum gear 18Y for driving the photosensitive drum 17Y, a deceleration gear 65Y as a second gear, and the connecting gear 70*a*.

Similarly, the third drive unit is formed of a photosensitive drum gear 18M for driving the photosensitive drum 17M, a deceleration gear 65M as a third gear, and the connecting gear 70*b*. The fourth drive unit is formed of a photosensitive drum gear 18C for driving the photosensitive drum 17C, a deceleration gear 65C as a fourth gear, and the connecting gear 70*c*.

In the embodiment, each of the deceleration idle gears 65 has a mark 120 (refer to FIG. 4) as a standard for aligning a position of the rotational phase thereof. Accordingly, it is possible to visually confirm a shift of rotational phases of adjacent gears. More specifically, marks 120B, 120Y, 120M, and 120C are disposed at a same position (a same teeth position) when the deceleration gears 65 are produced. Each of the deceleration idle gears 65 is produced using a mold metal having a same dimension.

As shown in FIG. 3, in the image forming apparatus 1, the ID unit drive motor 202 is connected to the large gear 66B of the deceleration gear 65B at the first row through a motor gear 203. Accordingly, in the image forming apparatus 1, the rotational drive of the ID unit drive motor 202 is transmitted to the large gear 66B of the deceleration gear 65B at the first row through the motor gear 203.

When the rotational drive of the ID unit drive motor 202 is transmitted to the large gear 66B of the deceleration gear 65B at the first row, the rotational drive is decelerated according to a gear ratio between the small gear 67B and the photosensitive drum gear 18B, and is transmitted to the photosensitive drum 17B. Accordingly, the photosensitive drum 17B at the first row rotates.

In the embodiment, the rotational drive of the ID unit drive motor 202 transmitted to the large gear 66B of the deceleration gear 65B at the first row is transmitted to the large gear 66Y of the deceleration gear 66Y at the second row through the connecting gear 70*a* at the first row.

When the rotational drive is transmitted of the ID unit drive motor 202 to the large gear 66Y of the deceleration gear 66Y at the second row, the rotational drive is decelerated according to a gear ratio between the small gear 67Y and the photosensitive drum gear 18Y, and is transmitted to the photosensitive drum 17Y. Accordingly, the photosensitive drum 17Y at the second row rotates.

Similarly, in the image forming apparatus 1, the rotational drive of the ID unit drive motor 202 is transmitted to the photosensitive drum 17M at the third row, so that the photosensitive drum 17M at the third row rotates. Further, the rotational drive of the ID unit drive motor 202 is transmitted to the photosensitive drum 17C at the fourth row, so that the photosensitive drum 17C at the fourth row rotates.

In the embodiment, the image forming apparatus 1 is configured such that the gears for driving the image supporting members or the photosensitive drums 17 have the rotational phases as shown in FIG. 4.

More specifically, in the image forming apparatus 1, the photosensitive drums 17B and 17Y form one pair, and the photosensitive drums 17M and 17C form another pair. In the one pair, the photosensitive drums 17B and 17Y have the deceleration gears 65 or the gears for driving the photosensitive drums 17B and 17Y having the rotational phases shifted by about 180 degrees (180 degrees plus minus 20 degrees) with each other. Accordingly, in the image forming apparatus 1, the photosensitive drums 17B and 17Y forming the one pair have inverted phases of variation cycles in the rotational speeds thereof with each other at abutting positions with respect to the transportation belt 12.

Figure 5:
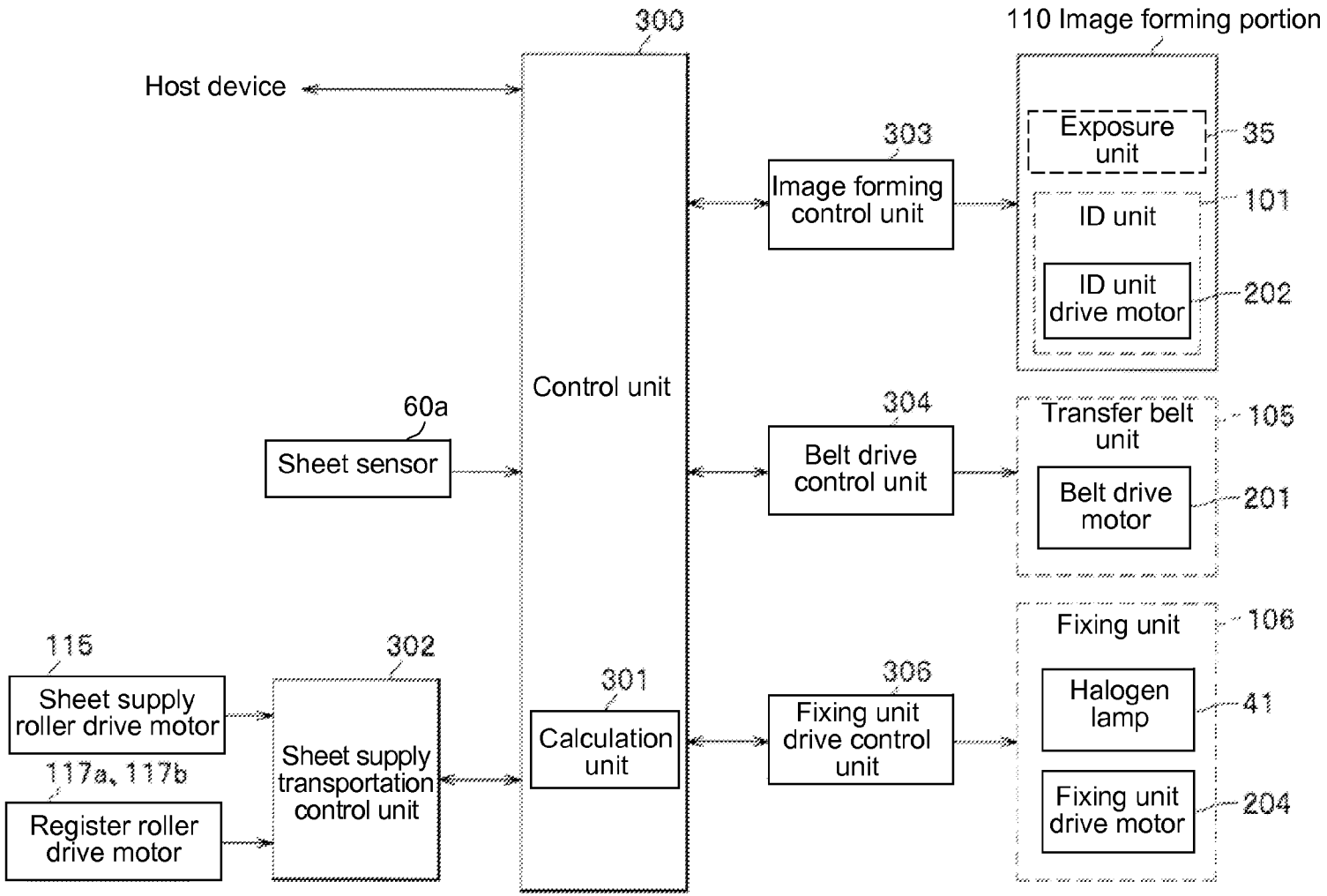
FIG. 5 is a block diagram showing a configuration of a control system of the image forming apparatus according to the first embodiment of the present invention.

A configuration of a control system of the image forming apparatus 1 will be explained next with reference to FIG. 5. FIG. 5 is a block diagram showing the configuration of the control system of the image forming apparatus 1 according to the first embodiment of the present invention.

As shown in FIG. 5, as functional units of the control system, the image forming apparatus 1 includes a control unit 300, a sheet supply transportation control unit 302, an image forming control unit 303, a belt drive control unit 304, a fixing unit drive control unit 306, and the likes.

In the embodiment, the control unit 300 is a functional unit provided for controlling an entire operation of the image forming apparatus 1. The sheet supply transportation control unit 302 is a functional unit provided for controlling an operation of a transportation unit ranging from the sheet supply cassette 2 to the transfer belt unit 105. As the transportation unit, the image forming apparatus 1 includes a sheet supply roller drive motor 115 for driving the sheet supply roller 5 to rotate, and register roller drive motors 117*a* and 117*b* for driving the register rollers 7*a* and 7*b* to rotate, respectively.

In the embodiment, the image forming control unit 303 is a functional unit provided for controlling an operation of the image forming portion 110. The belt drive control unit 304 is a functional unit provided for controlling an operation of the transfer belt unit 105. The fixing unit drive control unit 306 is a functional unit provided for controlling an operation of the fixing unit 106. Each of the functional units is formed of a storage unit such as an ROM and an RAM (not shown) and a CPU. Each of the functional units may be integrated with other functional unit.

In the embodiment, the control unit 300 includes a calculation unit 301. The calculation unit 301 is provided for controlling the sheet supply transportation control unit 302, the image forming control unit 303, the belt drive control unit 304, and the fixing unit drive control unit 306.

In the embodiment, when the calculation unit 301 receives a print instruction from a host device, the calculation unit 301 instructs the sheet supply transportation control unit 302 to perform a sheet supply process and a transportation process. Accordingly, the sheet supply transportation control unit 302 drives the sheet supply roller 5 (refer to FIG. 1) to rotate, thereby performing the sheet supply process. In the sheet supply process, the printing medium 100 placed on the sheet receiver 3 is picked up toward the transportation path and transported to the register roller 7*a*.

In the next step, the sheet supply transportation control unit 302 performs the transportation process. In the transportation process, the sheet supply transportation control unit 302 drives the register rollers 7*a* and 7*b* to rotate, so that the printing medium 100 is transported toward the downstream side of the transportation path.

In the embodiment, in the image forming apparatus 1, when the printing medium 100 passes through the sheet sensor 60*a*, the sheet sensor 60*a* notifies the control unit 300 of a passing timing. Afterward, the control unit 300 notifies the passing timing to the image forming control unit 303 and the belt drive control unit 304.

In the embodiment, the image forming control unit 303 controls an operation of the image forming apparatus 1, so that the following processes are performed. First, the image forming control unit 303 controls the exposure units 35B, 35Y, 35M, and 35C to form the static latent images on the photosensitive drums 17B, 17Y, 17M, and 17C at timings corresponding to installed positions of the photosensitive drums 17B, 17Y, 17M, and 17C of the ID units 101. Then, the image forming control unit 303 controls the developing rollers 21B, 21Y, 21M, and 21C to attach toner to the static latent images through an electrostatic force, thereby forming (developing) the toner images.

In the embodiment, the belt drive control unit 304 controls a rotational drive of the belt drive motor 201. More specifically, the rotational drive of the belt drive motor 201 is transmitted to the belt drive roller 10 through a drive transmission unit (not shown), so that the belt drive roller 10 drives the transportation belt 12 to move through frictional resistance therebetween. The printing medium 100 is attached to the transportation belt 12 through an electrostatic force. Accordingly, when the transportation belt 12 moves, the printing medium 100 is transported toward the downstream side, so that the toner images developed on the photosensitive drums 17B, 17Y, 17M, and 17C are overlapped and transferred to the printing medium 100.

In the embodiment, after the toner images are transferred to the printing medium 100, the transportation belt 12 transports the printing medium 100 to the fixing unit 106. At this moment, the calculation unit 301 instructs the fixing unit drive control unit 306 to perform a fixing process. Accordingly, the fixing unit drive control unit 306 controls the operation of the fixing unit 106 to perform the fixing process as follows. First, the fixing unit drive control unit 306 controls the halogen lamp 41 as the heating source of the fixing unit 106 to turn on to obtain a temperature and a speed instructed with the control unit 300.

In the next step, the fixing unit drive control unit 306 controls the fixing unit drive motor 204 to rotate, so that the fixing roller 39 rotates. When the fixing roller 39 rotates, the fixing roller 39 transports the printing medium 100 to the discharge roller 43*a* and the discharge roller 44*a*. Accordingly, the toner images transferred to the printing medium 100 are melted and fixed to the printing medium 100. Afterward, the discharge roller 43*a*, the discharge roller 44*a*, the transportation roller 43*b*, the transportation roller 44*b*, a discharge roller 43*c*, and a discharge roller 44*c* sequentially transport the printing medium 100 to the facedown stacker 49, so that the printing medium 100 is discharged on the facedown stacker 49.

An operation of the photosensitive drums 17 and the transportation belt 12 will be explained next with reference to FIGS. 2 and 3. As shown in FIG. 3, the ID unit drive motor 202 drives each of the photosensitive drums 17B, 17Y, 17M, and 17C through each of the deceleration gears 65B, 65Y, 65M, and 65C and each of the connecting gears 70*a*, 70*b*, and 70*c*. At this moment, the surfaces of the photosensitive drums 17B, 17Y, 17M, and 17C cause speed fluctuations or speed variances due to specific characteristic (for example, a deviation due to a dimensional accuracy of the gears engaging with other or a waggle tolerance of the gear from an axial center thereof).

When the surfaces of the photosensitive drums 17B, 17Y, 17M, and 17C cause the speed fluctuations, the speed fluctuations are transmitted to a speed of the transportation belt 12 and a speed of the printing medium 100 through a frictional force therebetween. As a result, a surface of a specific photosensitive drum (the photosensitive drum 17B at the first row in FIG. 2) has a speed V1, while a surface of another photosensitive drum (the photosensitive drum 17Y at the second row in FIG. 2) has a speed V2. At this moment, the transportation belt 12 has a speed VB.

A relationship between the speed fluctuations of the surface of the photosensitive drums 17 (referred to as a speed fluctuation of the photosensitive drum 17) and the speed fluctuation of the transportation belt 12 (referred to as a speed fluctuation of the transportation belt 12) in the image forming apparatus 1 will be explained next with reference to FIGS. 6 to 9.

As described above, the ID units 101 are produced using the identical components through the same manufacturing process, so that the ID units 101 have the identical operational characteristic. Accordingly, the deceleration gears 65B, 65Y, 65M, and 65C for driving the photosensitive drums 17B, 17Y, 17M, and 17C have an identical characteristic. Further, rotations of the deceleration gears 65B, 65Y, 65M, and 65C are directly transmitted to the photosensitive drums 17B, 17Y, 17M, and 17C, respectively. Accordingly, when the deceleration gears 65B, 65Y, 65M, and 65C drive the photosensitive drums 17B, 17Y, 17M, and 17C, speeds of the photosensitive drums 17B, 17Y, 17M, and 17C are fluctuated in a similar manner.

In the following description, it is supposed that the speed fluctuations of the photosensitive drums 17B, 17Y, 17M, and 17C and the speed fluctuation of the transportation belt 12 have a cyclic wave shape (a cosign curve in an example shown in FIG. 9) with a cycle T. Further, it is supposed that two of the photosensitive drums 17B, 17Y, 17M, and 17C constitute one pair. With respect to the two of the photosensitive drums 17B, 17Y, 17M, and 17C (referred to as a first photosensitive drum and a second photosensitive drum), the relationship between the speed fluctuations of the photosensitive drums 17 and the speed fluctuation of the transportation belt 12 will be explained.

In the following description, the photosensitive drums 17B and 17Y will be explained as the first photosensitive drum and the second photosensitive drum, respectively. Note that the first photosensitive drum and the second photosensitive drum are not limited to the photosensitive drums 17B and 17Y, and may be other photosensitive drums such as the photosensitive drums 17Y and 17M.

Figure 6:
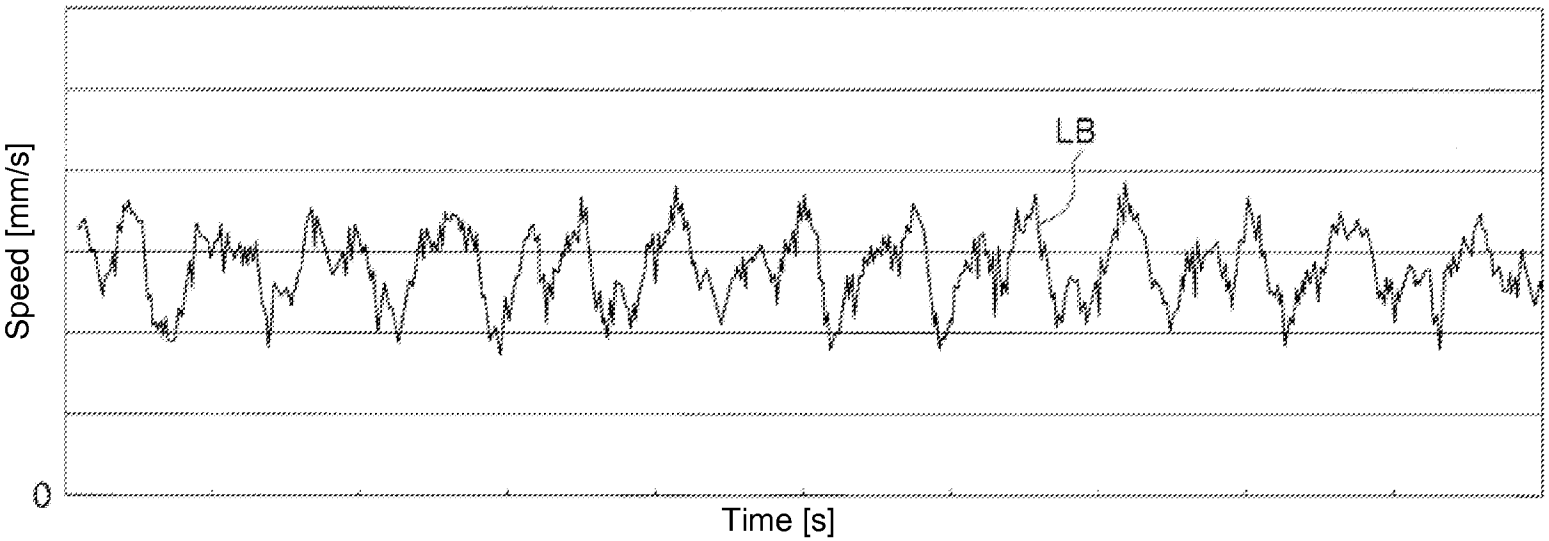
FIG. 6 CONVENTIONAL ART
FIG. 6 is a graph No. 1 showing a speed fluctuation of a transportation belt of a conventional image forming apparatus.
Figure 7:
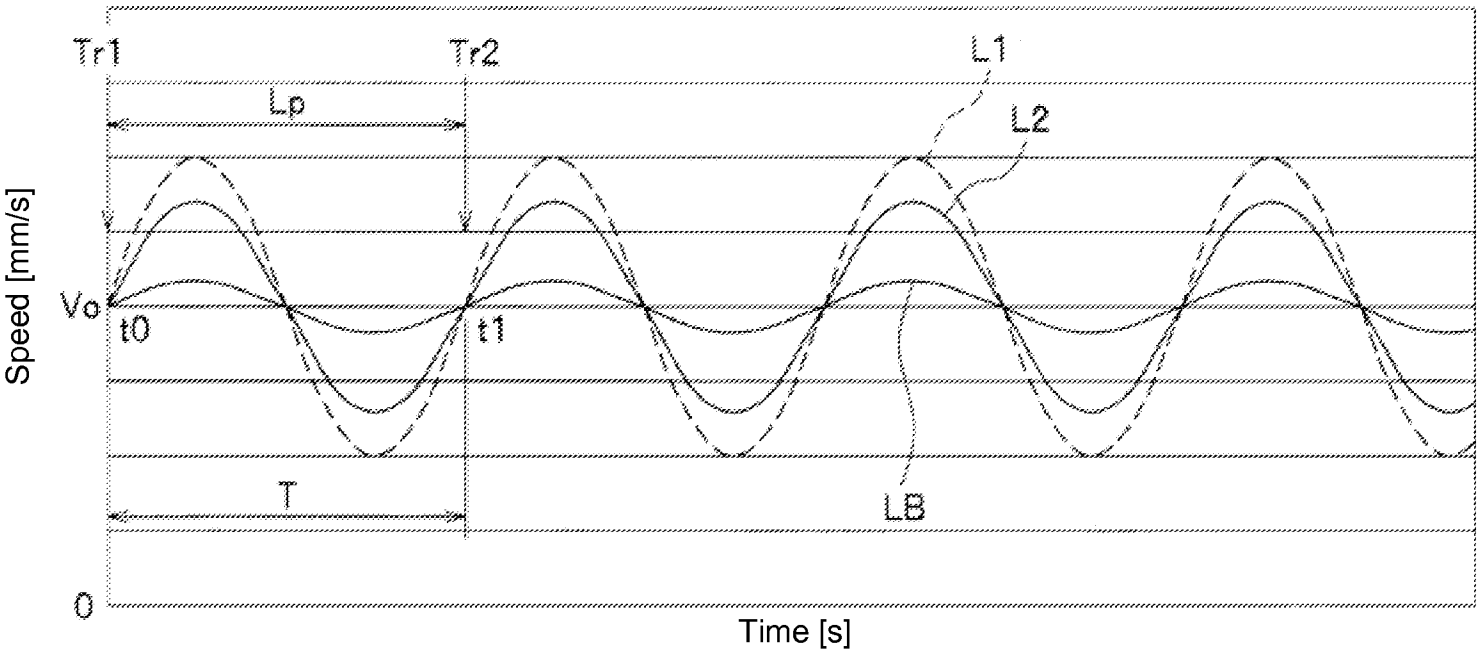
FIG. 7 CONVENTIONAL ART
FIG. 7 is a graph No. 2 showing the speed fluctuation of the transportation belt of the conventional image forming apparatus.
Figure 8:
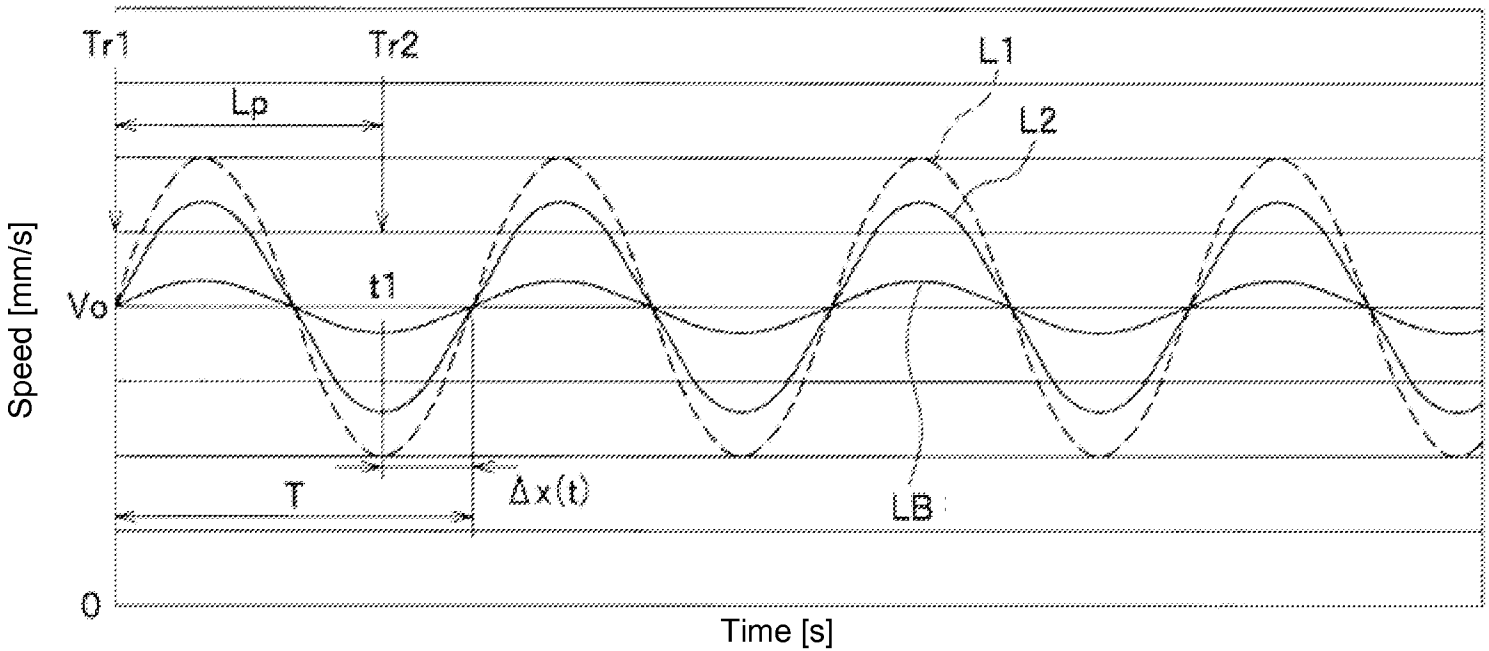
FIG. 8 CONVENTIONAL ART
FIG. 8 is a graph No. 3 showing the speed fluctuation of the transportation belt of a conventional image forming apparatus.
Figure 9:
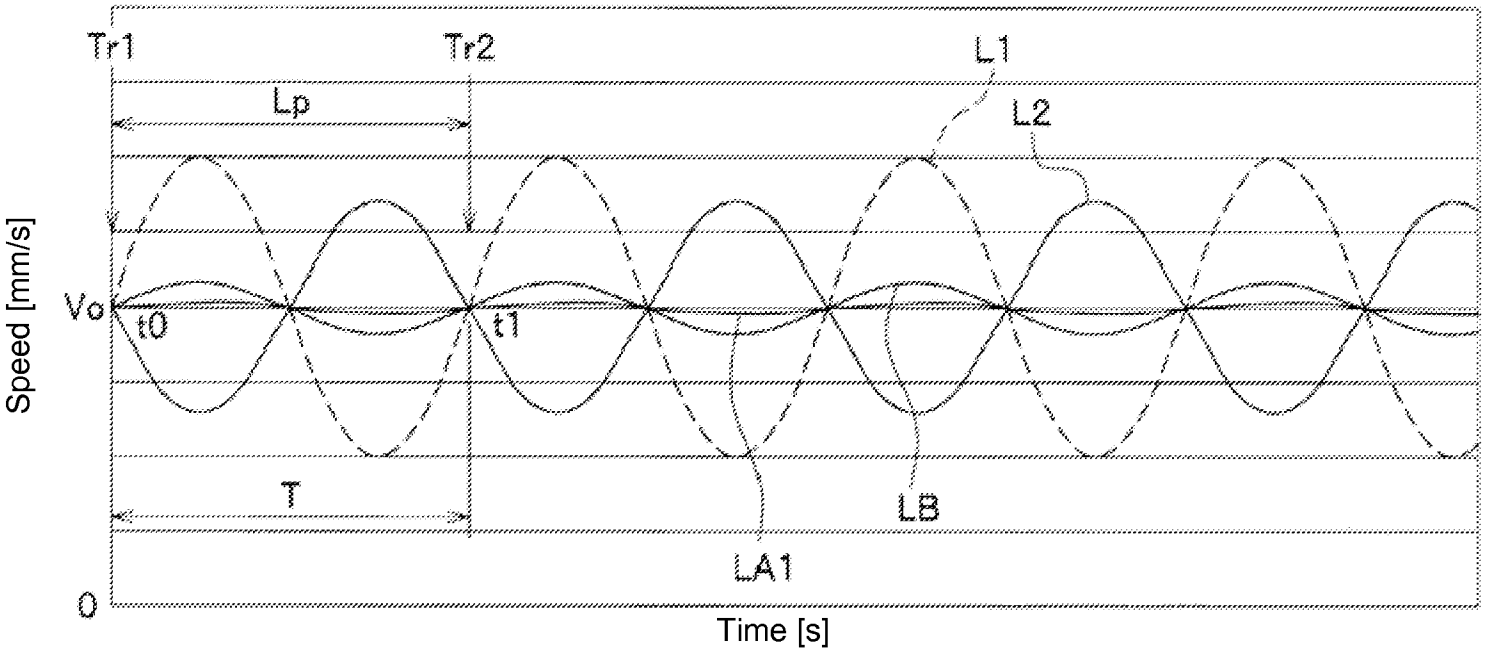
FIG. 9 is a graph showing a speed fluctuation of the transportation belt of the image forming apparatus according to the first embodiment of the present invention.

FIG. 6 is a graph No. 1 showing a speed fluctuation of a transportation belt of a conventional image forming apparatus according to a conventional technology. FIG. 7 is a graph No. 2 showing the speed fluctuation of the transportation belt of the conventional image forming apparatus. FIG. 8 is a graph No. 3 showing the speed fluctuation of the transportation belt of a conventional image forming apparatus. FIG. 9 is a graph showing the speed fluctuation of the transportation belt 12 of the image forming apparatus 1 according to the first embodiment of the present invention.

More specifically, FIG. 6 is the graph No. 1 showing an actual measurement result of the speed fluctuation of the transportation belt of the conventional image forming apparatus according to the conventional technology.

FIG. 7 is the graph No. 2 showing a schematic wave shape of the speed fluctuation of the transportation belt of the conventional image forming apparatus when the pitch distance Lp is set at an optimal level. When the pitch distance Lp is set at the optimal level, a transportation distance of a printing medium (i.e., a moving distance of the transportation belt) relative to the cycle T of the speed fluctuation of the photosensitive drum becomes a fraction of an integer of the pitch distance. FIG. 8 is the graph No. 3 showing a schematic wave shape of the speed fluctuation of the transportation belt of the conventional image forming apparatus when the pitch distance Lp is not set at the optimal level.

As shown in FIG. 6, the speed fluctuation of the transportation belt of the conventional image forming apparatus has a wave shape LB. As shown in FIGS. 7 and 8, the speed fluctuation of the first photosensitive drum has a wave shape L1, and the speed fluctuation of the second photosensitive drum has a wave shape L2. In FIGS. 7 and 8, the toner image formed on the first photosensitive drum is transferred at a first transfer position Tr1, and the toner image formed on the second photosensitive drum is transferred at a second transfer position Tr2.

FIG. 9 is the graph showing the speed fluctuation of the transportation belt 12 of the image forming apparatus 1 according to the first embodiment of the present invention as compared with the speed fluctuation of the transportation belt of the conventional image forming apparatus. As shown in FIG. 9, the speed fluctuation of the transportation belt 12 of the image forming apparatus 1 has a wave shape LA1.

As shown in the example shown in FIG. 7, the speed fluctuation of the first photosensitive drum and the speed fluctuation of the second photosensitive drum have the constant cycle T (second). Further, the speed fluctuation of the first photosensitive drum and the speed fluctuation of the second photosensitive drum are transmitted to the transportation belt. Accordingly, the speed of the transportation belt is fluctuated at a transmission efficiency (W) corresponding to 5 to 20% of a combined wave shape of the speed fluctuation of the first photosensitive drum and the speed fluctuation of the second photosensitive drum.

As a result, as shown in FIG. 7, the speed of the transportation belt is fluctuated based on a cosign curve with the cycle T and a vibration amplitude Vo×W, in which Vo is an average speed. More specifically, the speed of the transportation belt is fluctuated based on the cosign curve represented with the following equation (1). Note that FIG. 7 is the graph No. 2 showing the schematic wave shape of the speed fluctuation of the transportation belt of the conventional image forming apparatus when the pitch distance Lp is set at the optimal level.

$$V(t) = V_0 W \sin\left(\frac{2\pi t}{T}\right) \tag{1}$$

In the following description, it is supposed that after the toner image in one color formed on the first photosensitive drum is transferred to the printing medium, the toner image in another color formed on the second photosensitive drum is transferred to the printing medium. At this moment, due to the speed fluctuation of the transportation belt, the two toner images are transferred to positions shifted with each other (that is, the color shift).

An amount of the shifted positions of the two toner images (that is, an amount of the color shift) Δx(t) is represented with the following equation (2):

$$\Delta x(t) = \int_{t0}^{t1} \frac{dv(t)}{dt} \tag{2}$$

where ΔV(t) is the speed fluctuation of the transportation belt; t0 is a time when the first transfer position Tr1 of the first photosensitive drum passes through a specific position of the surface of the transportation belt (a specific position of the printing medium transported with the transportation belt); and t1 is a time when the second transfer position Tr2 of the second photosensitive drum passes through the specific position of the surface of the transportation belt.

Next, as shown in FIG. 7, it is supposed that the fluctuation cycle T of the average speed Vo of the transportation belt becomes a difference between t1 and t0 (T=t1−t0) or an n times of the fluctuation cycle T becomes the difference (n×T=(t1−t0)), in which n is a natural number.

In this case, the amount of the shifted positions of the two toner images (that is, the amount of the color shift) Δx(t) is represented with the following equation (3):

$$\begin{aligned}\Delta x(t) &= -V_0 W \frac{T}{2\pi}\left[\cos\left(\frac{2\pi}{T}\right)\right]_{t0}^{t1} \\ &= V_0 W \frac{T}{\pi}\left\{\sin\frac{\pi}{T}(t_1+t_0)\times\sin\frac{\pi}{T}(t_1-t_0)\right\} \\ &= 0 \\ &\quad (\because (t_1-t_0) = n\times T)\end{aligned} \tag{3}$$

In this case, the amount of the shifted positions of the two toner images (that is, the amount of the color shift) Δx(t) becomes zero (Δx(t)=0). Accordingly, the color shift does not occur on the surface of the transportation belt and the surface of the printing medium transported with the transportation belt.

In the conventional image forming apparatus, it is difficult to set the pitch distance at the optimal level due to a restriction of an apparatus size and a cost. More specifically, it is difficult to set the transportation distance of the printing medium (the moving distance of the transportation belt) relative to the cycle T of the speed fluctuation of the photosensitive drum to a fraction of an integer of the pitch distance Lp.

FIG. 8 is the graph No. 3 showing the schematic wave shape of the speed fluctuation of the transportation belt of the conventional image forming apparatus when the pitch distance Lp is not set at the optimal level.

As shown in FIG. 8, the fluctuation cycle T of the average speed Vo of the transportation belt is not equal to the difference between t1 and t0 (T=t1−t0) or the n times of the fluctuation cycle T is not equal to the difference (n×T=(t1−t0)), in which n is a natural number. In this case, the pitch distance Lp is not equal to the cycle T (Lp≠T), so that the amount of the color shift is not equal to zero. Accordingly, the color shift by the amount Δx(t) occurs on the surface of the transportation belt and the surface of the printing medium transported with the transportation belt.

In the embodiment, as shown in FIG. 9, the image forming apparatus 1 is configured such that the cycles T of the speed fluctuations of the first photosensitive drum 17B and the second photosensitive drum 17Y have inverted phases at a same position on the surface of the transportation belt 12.

More specifically, in the image forming apparatus 1, the deceleration gear 65B at the first row for driving the first photosensitive drum 17B is arranged to have the rotational phase shifted by about 180 degrees with respect to that of the deceleration gear 65Y at the second row for driving the second photosensitive drum 17Y. Accordingly, the mark 120B is in an inverted phase with respect to the mark 120Y as shown in FIG. 4. As a result, as shown in FIG. 9, in the image forming apparatus 1, it is possible to minimize the speed fluctuation of the transportation belt 12 at a minimum level.

In the embodiment, similarly, the deceleration gear 65M at the third row for driving the photosensitive drum 17M is arranged to have the rotational phase shifted by about 180 degrees with respect to that of the deceleration gear 65C at the fourth row for driving the photosensitive drum 17C. Accordingly, the mark 120M is in an inverted phase with respect to the mark 120C as shown in FIG. 4. As a result, as shown in FIG. 9, in the image forming apparatus 1, it is possible to further minimize the speed fluctuation of the transportation belt 12 at a minimum level.

As described above, in the image forming apparatus 1 in the first embodiment, the deceleration gears 65, which cause the speed fluctuations of the photosensitive drums 17B, 17Y, 17M, and 17C, have the rotational phases shifted by about 180 degrees with each other. Accordingly, even when it is difficult to set the pitch distance Lp at the optimal level, that is, to set the transportation distance of the printing medium 100 (the moving distance of the transportation belt 12) relative to the cycle T of the speed fluctuations of the photosensitive drums 17 to a fraction of an integer of the pitch distance Lp, it is possible to minimize the speed fluctuation of the transportation belt 12 at a minimum level. As a result, it is possible to minimize a reduction in an accuracy of the color shift (an accuracy of overlap printing in each color) to a minimum level. Further, it is possible to prevent the color shift through a simple control of the printing mechanisms.

Further, in the image forming apparatus 1 in the first embodiment, it is possible to freely set the rotational phases of one pair of the photosensitive drums relative to another pair (or more than one pair) of the photosensitive drums. Accordingly, for example, even when one pair of the photosensitive drums have a drive gear row separated from that of another pair (or more than one pair) of the photosensitive drums, it is possible to arrange the drive gear row regardless of the phases thereof.

Second Embodiment

Figure 10:
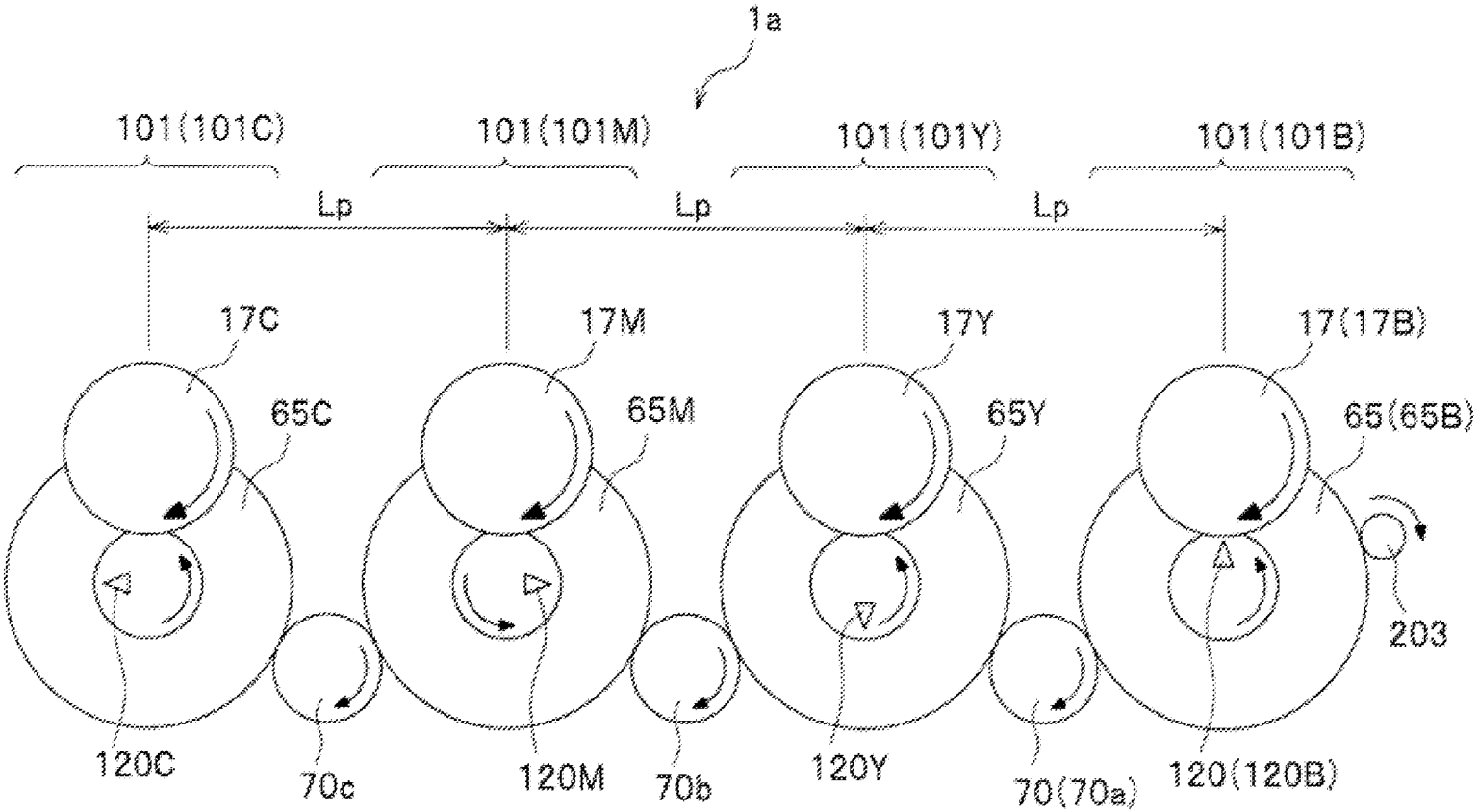
FIG. 10 is a schematic view showing a rotational phase of gears of an image forming apparatus according to a second embodiment of the present invention.

A second embodiment of the present invention will be explained next. A configuration of an image forming apparatus 1*a* will be explained with reference to FIG. 10. FIG. 10 is a schematic view showing a rotational phase of gears for driving the image supporting members 17 of the image forming apparatus la according to the second embodiment of the present invention.

In the first embodiment, in the image forming apparatus 1 (refer to FIG. 4), two of the deceleration gears 65B, 65Y, 65M, and 65C for driving two of the photosensitive drums 17B, 17Y, 17M, and 17C form one pair, and the two of the deceleration gears 65B, 65Y, 65M, and 65C have the rotational phases shifted by about 180 degrees with each other.

In the second embodiment, in the image forming apparatus 1*a*, two of the deceleration gears 65B, 65Y, 65M, and 65C for driving two of the photosensitive drums 17B, 17Y, 17M, and 17C form one pair, so that two pairs are formed. Further, one of the two pairs of the deceleration gears 65B, 65Y, 65M, and 65C have the rotational phases shifted by about 180 degrees with each other, and the other of the two pairs of the deceleration gears 65B, 65Y, 65M, and 65C have the rotational phases shifted by about 90 degrees relative to those of the one of the two pairs.

When the rotational phases of the deceleration gears 65B, 65Y, 65M, and 65C are shifted by about 90 degrees, a variance in a degree of the shift may occur due to the engagement or accuracy of the gears of the gear rows. In this case, when the shifted angle is within 70 degrees and 110 degrees (90 degrees plus minus 20 degrees), it is possible to obtain a similar effect.

Figure 11:
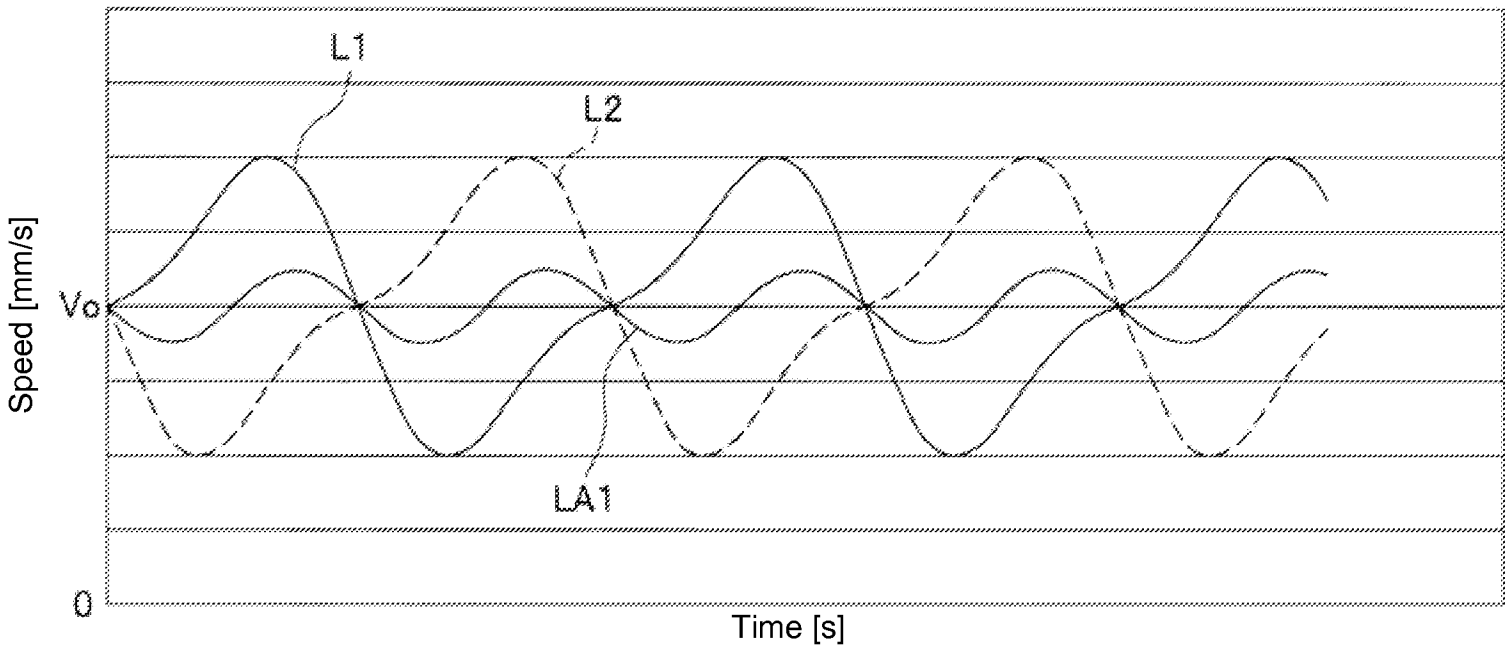
FIG. 11 is a graph No. 1 showing the speed fluctuation of the transportation belt of the image forming apparatus according to the first embodiment of the present invention.
Figure 12:
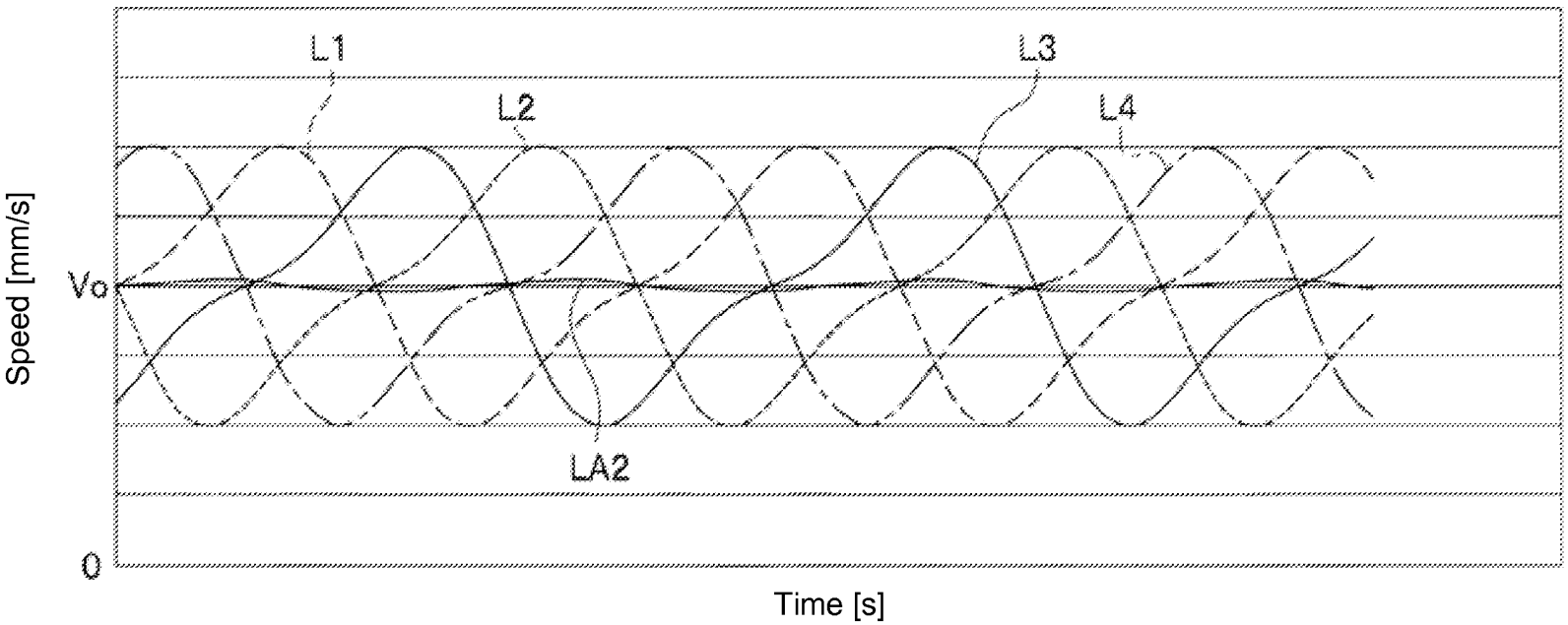
FIG. 12 is a graph No. 2 showing a speed fluctuation of a transportation belt of the image forming apparatus according to the second embodiment of the present invention.

A relationship between the speed fluctuations of the photosensitive drums 17 and the speed fluctuation of the transportation belt 12 in the image forming apparatus 1*a* will be explained next with reference to FIGS. 11 and 12. FIGS. 11 and 12 are graphs showing the speed fluctuation of the transportation belt 12.

More specifically, FIG. 11 is a graph No. 1 showing the speed fluctuation of the transportation belt 12 of the image forming apparatus 1 according to the first embodiment of the present invention as a comparison. As shown in FIG. 11, the speed fluctuation of the first photosensitive drum 17B and the speed fluctuation of the second photosensitive drum 17Y have the wave shapes with a harmonic component, and the harmonic component is laterally asymmetric.

FIG. 12 is a graph No. 2 showing the speed fluctuation of the transportation belt 12 of the image forming apparatus 1*a* according to the second embodiment of the present invention. As shown in FIG. 12, the speed fluctuations of the photosensitive drums 17B, 17Y, 17M, and 17C have laterally asymmetric wave shapes. Note that, in FIG. 12, the photosensitive drums 17B, 17Y, 17M, and 17C are represented as the first photosensitive drum 17B, the second photosensitive drum 17Y, the third photosensitive drum 17M, and the fourth photosensitive drum 17C, respectively. The first photosensitive drum 17B, the second photosensitive drum 17Y, the third photosensitive drum 17M, and the fourth photosensitive drum 17C exhibit the speed fluctuations having wave shapes L1, L2, L3, and L4, respectively. Further, the transportation belt 12 of the image forming apparatus la exhibits the speed fluctuation having a wave shape LA2.

As described above, in the first embodiment, in the image forming apparatus 1 (refer to FIG. 4), two of the deceleration gears 65B, 65Y, 65M, and 65C for driving two of the photosensitive drums 17B, 17Y, 17M, and 17C form one pair, and the two of the deceleration gears 65B, 65Y, 65M, and 65C have the rotational phases shifted by about 180 degrees with each other. In other words, the image forming apparatus 1, among the deceleration gears 65B, 65Y, 65M, and 65C for driving the photosensitive drums 17B, 17Y, 17M, and 17C, one pair of the two of the deceleration gears 65B, 65Y, 65M, and 65C have the rotational phases shifted by about 180 degrees.

In this case, as shown in FIG. 4, the deceleration gears 65Y, 65M, and 65C are shifted by an equal interval of about 180 degrees as a specific angle with the deceleration gear 65B as a standard. When the rotational phases of the deceleration gears 65B, 65Y, 65M, and 65C are shifted by about 180 degrees, a variance in a degree of the shift may occur due to the engagement or accuracy of the gears of the gear rows. In this case, when the shifted angle is within 160 degrees and 200 degrees (180 degrees plus minus 20 degrees), it is possible to obtain a similar effect.

Accordingly, in the first embodiment, it is possible to minimize the speed fluctuation of the transportation belt 12 to a minimum level when the speed fluctuations of the photosensitive drums 17B, 17Y, 17M, and 17C have the wave shapes similar to a cosign curve or an approximate cosign curve.

However, in the image forming apparatus 1, the speed fluctuations of the photosensitive drums 17B, 17Y, 17M, and 17C may not have the wave shapes similar to a cosign curve or an approximate cosign curve. In this case, as shown in FIG. 11, the transportation belt 12 of the image forming apparatus 1 exhibits the speed fluctuation having the wave shape LA1. More specifically, the speed fluctuation does not have a flat wave shape when only two of the deceleration gears 65B, 65Y, 65M, and 65C for driving two of the photosensitive drums 17B, 17Y, 17M, and 17C have the rotational phases shifted by about 180 degrees with each other.

On the other hand, in the image forming apparatus 1*a* in the second embodiment as described above, two of the deceleration gears 65B, 65Y, 65M, and 65C for driving two of the photosensitive drums 17B, 17Y, 17M, and 17C form one pair, so that two pairs are formed. Further, one of the two pairs of the deceleration gears 65B, 65Y, 65M, and 65C have the rotational phases shifted by about 180 degrees with each other, and the other of the two pairs of the deceleration gears 65B, 65Y, 65M, and 65C have the rotational phases shifted by about 90 degrees relative to those of the one of the two pairs. In other words, in the image forming apparatus 1*a*, the deceleration gears 65B, 65Y, 65M, and 65C for driving the photosensitive drums 17B, 17Y, 17M, and 17C have the rotational phases shifted by about 90 degrees with each other.

Accordingly, even when the speed fluctuations of the photosensitive drums 17B, 17Y, 17M, and 17C have the laterally asymmetric wave shapes deviated from a cosign curve, the transportation belt 12 of the image forming apparatus 1*a* exhibits the speed fluctuation having the wave shape LA2 as shown in FIG. 12.

More specifically, the two pairs of the deceleration gears 65B, 65Y, 65M, and 65C (the deceleration gears 65B and 65Y and the deceleration gears 65M and 65C in the example shown in FIG. 10) for driving the photosensitive drums 17B, 17Y, 17M, and 17C (the photosensitive drums 17B and 17Y and the photosensitive drums 17M and 17C in the example shown in FIG. 10) have the rotational phases inverted with each other. Accordingly, it is possible to efficiently suppress the speed fluctuation of the transportation belt 12.

As described above, in the image forming apparatus la in the second embodiment, similar to the image forming apparatus 1 in the first embodiment, even when it is difficult to set the pitch distance Lp at the optimal level, it is possible to minimize the speed fluctuation of the transportation belt 12 at a minimum level. As a result, it is possible to minimize a reduction in an accuracy of the color shift (an accuracy of overlap printing in each color) to a minimum level. Further, it is possible to prevent the color shift through a simple control of the printing mechanisms.

Further, in the image forming apparatus 1*a* in the second embodiment, as compared with the image forming apparatus 1 in the first embodiment, even when the speed fluctuations of the photosensitive drums 17B, 17Y, 17M, and 17C have the laterally asymmetric wave shapes deviated from a cosign curve, it is possible to minimize the speed fluctuation of the transportation belt 12 at a minimum level. As a result, without increasing cost, it is possible to improve an accuracy of the color shift (an accuracy of overlap printing in each color) due to the speed fluctuation of the transportation belt 12.

In the embodiments described above, the color printer of the electro-photography type is explained as the image forming apparatus. The present invention is applicable to a monochrome printer, a copier, a facsimile, a multi-function product, and the likes.

Further, it is possible to change the order of the colors to be printed (that is, the arrangement of the ID units 101). Further, it is possible to change toner in black, yellow, magenta, and cyan retained in the image forming portion 110 to toner in other colors. Further, it is possible to change the image forming portion 110 to form an image in other colors in addition to the images in black, yellow, magenta, and cyan.

The disclosure of Japanese Patent Application No. 2009-118226, filed on May 15, 2009, is incorporated in the application.

While the invention has been explained with reference to the specific embodiments of the invention, the explanation is illustrative and the invention is limited only by the appended claims.

What is claimed is:

1. An image forming apparatus comprising:

a first image supporting member for forming a first image;

a second image supporting member arranged adjacent to the first image supporting member for forming a second image, said second image supporting member being arranged to be paired with the first image supporting member as a first pair;

a third image supporting member for forming a third image;

a fourth image supporting member for forming a fourth image, said fourth image supporting member being arranged to be paired with the third image supporting member as a second pair;

a first drive unit having a first phase for driving the first image supporting member;

a second drive unit having a second phase shifted from the first phase for driving the second image supporting member;

a third drive unit having a third phase for driving the third image supporting member;

a fourth drive unit having a fourth phase shifted from the third phase by an angle of about 180 degrees for driving the fourth image supporting member; and a transfer unit for transferring the first image and the second image to a printing medium, wherein said second drive unit is arranged to have the second phase shifted from the first phase by an angle of about 180 degrees, said third drive unit is arranged to have the third phase shifted from the first phase by an angle of about 90 degrees, and said fourth drive unit is arranged to have the fourth phase shifted from the first phase by an angle of about 90 degrees.

2. The image forming apparatus according to claim 1, where at least one of said first drive unit and said second drive unit includes a mark.

3. The image forming apparatus according to claim 1, wherein said first drive unit includes a first gear and said second drive unit includes a second gear.

4. The image forming apparatus according to claim 3, wherein said first gear has a shape substantially the same as that of the second gear.

5. The image forming apparatus according to claim 3, wherein said first gear includes a first positioning mark and said second gear includes a second positioning mark.

6. The image forming apparatus according to claim 1, further comprising a drive source for transmitting a drive force to the first drive unit, the second drive unit, the third drive unit, and the fourth drive unit.

7. An image forming apparatus comprising:

a first image supporting member for forming a first image;

a second image supporting member arranged adjacent to the first image supporting member for forming a second image, said second image supporting member being arranged to be paired with the first image supporting member as a first pair;

a third image supporting member for forming a third image;

a fourth image supporting member for forming a fourth image, said fourth image supporting member being arranged to be paired with the third image supporting member as a second pair;

a first drive unit including a first gear for driving the first image supporting member, said first gear having a first rotational phase;

a second drive unit including a second gear for driving the second image supporting member, said second gear having a second rotational phase shifted from the first rotational phase by an angle of about 180 degrees;

a third drive unit including a third gear for driving the third image supporting member;

a fourth drive unit including a fourth gear for driving the fourth image supporting member; and a transfer unit including a transportation belt for transferring the first image and the second image to a printing medium, wherein said third drive unit is arranged to have the third rotational phase shifted from the first rotational phase by an angle of about 90 degrees, and said fourth drive unit is arranged to have the fourth rotational phase shifted from the first rotational phase by an angle of about 90 degrees.

8. The image forming apparatus according to claim 7, further comprising a drive source having a motor gear.

9. The image forming apparatus according to claim 8, wherein said first image supporting member includes a first drum gear, said first gear including a first small gear for engaging the first drum gear and a first large gear for engaging the motor gear.

10. The image forming apparatus according to claim 7, wherein said second image supporting member includes a second drum gear, said second gear including a second small gear for engaging the second drum gear and a second large gear for engaging a first connecting gear disposed between the first gear and the second gear.

11. The image forming apparatus according to claim 10, wherein said third image supporting member includes a third drum gear, said third gear including a third small gear for engaging the third drum gear and a third large gear for engaging a second connecting gear disposed between the second gear and the third gear, said second connecting gear having a diameter equal to that of the first connecting gear.

12. The image forming apparatus according to claim 11, wherein said first small gear includes a first positioning mark at a first position, said second small gear includes a second positioning mark at a second position same as the first position, and said third small gear includes a third positioning mark at a third position same as the first position.

13. The image forming apparatus according to claim 7, further comprising a drive source for transmitting a drive force to the first drive unit, the second drive unit, the third drive unit, and the fourth drive unit.

* * * * *